US005175937A

United States Patent [19]

Emerson, III

[11] Patent Number: 5,175,937

[45] Date of Patent: Jan. 5, 1993

[54] BOW TUNING GAUGE

[76] Inventor: Jerry T. Emerson, III, 123 Three Prong Rd., Brandon, Miss. 39042

[21] Appl. No.: 760,116

[22] Filed: Sep. 16, 1991

[51] Int. Cl.[5] ..... F41B 5/14

[52] U.S. Cl. ..... 33/503; 124/88

[58] Field of Search ..... 33/506; 124/86, 88, 124/89, 90, 91, 24.1

[56] References Cited

U.S. PATENT DOCUMENTS

| | | | |
|---|---|---|---|
| 3,651,578 | 3/1972 | Saunders | 33/506 |
| 3,866,592 | 2/1975 | Carella | 124/88 |
| 4,385,618 | 5/1983 | Nishioka | 124/90 |
| 4,594,786 | 6/1986 | Rezmer | 33/506 |
| 4,596,229 | 6/1986 | Bell | 124/88 |
| 4,605,223 | 8/1986 | Rainville | 124/90 |
| 4,911,137 | 3/1990 | Troncoso | 124/86 |
| 4,974,576 | 12/1990 | Morey et al. | 124/88 |
| 4,993,397 | 2/1991 | Cryar et al. | 124/88 |
| 5,060,627 | 10/1991 | Fenchel | 124/88 |
| 5,062,407 | 11/1991 | Newbold | 124/24.1 |

*Primary Examiner*—Thomas B. Will

[57] ABSTRACT

A bow tuning gauge has an elongated body and two sets of horizontal and vertical gauges attached thereto at either end. The gauge, when attached to an archery bow, enables the user to position an arrow shaft at a precise perpendicular state in relation to the bow. An arrow shaft is placed in two metal clips at the end of the horizontal gauges, which in turn are positioned by the vertical gauges. The arrow shaft is moved left and right until the arrow shaft is in proper alignment with the bow string (center shot). The vertical gauges are used to align the arrow shaft vertically across the tune hole. Once proper horizontal and vertical positions are found, the arrow shaft is slid back to bow string and the bow string may then be nocked. After center shot has been located, an arrow rest can be bolted on the bow in the optimum position, and the bow can be adjusted.

2 Claims, 2 Drawing Sheets

FIG. 2-A
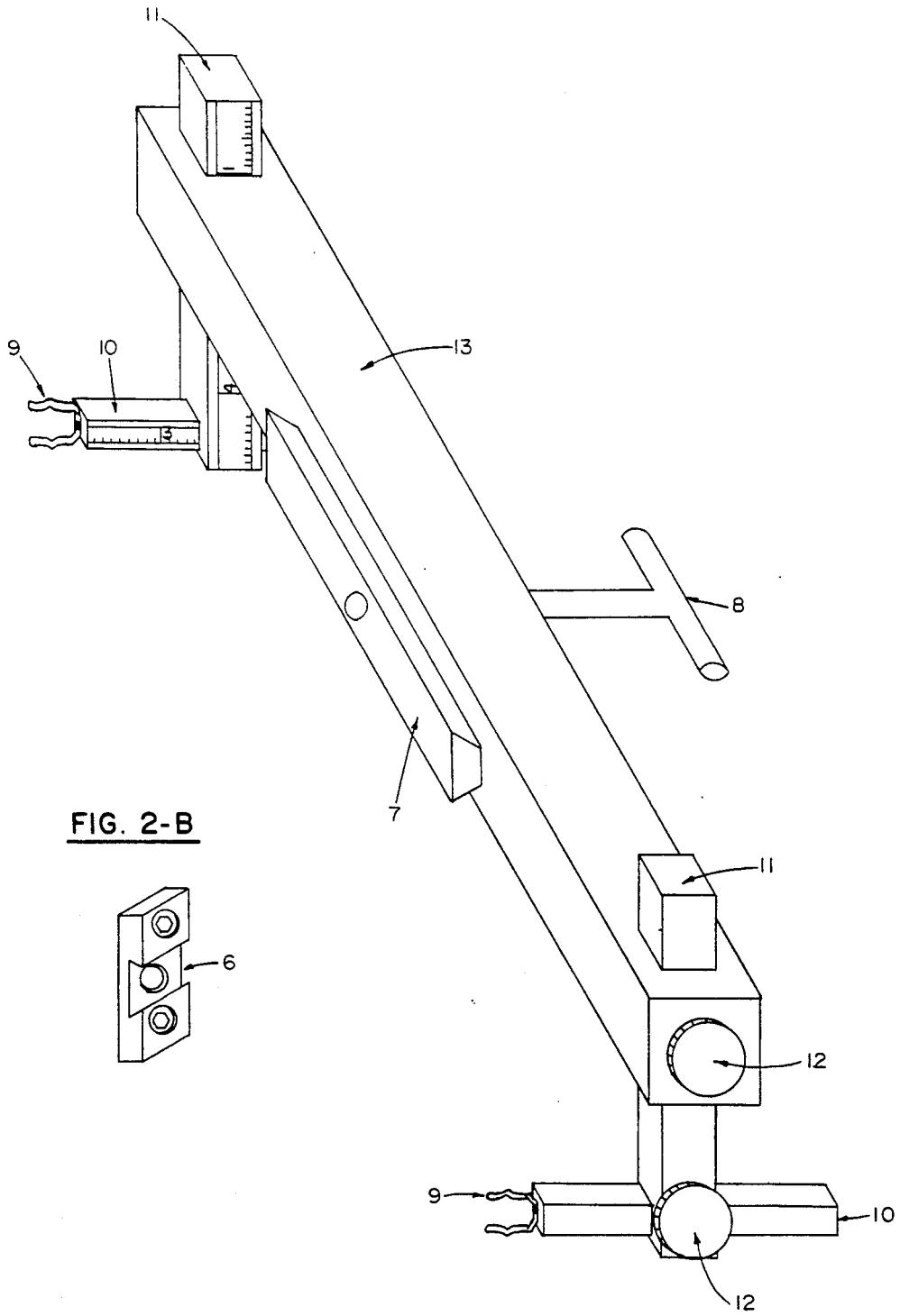
FIG. 2-B

BOW TUNING GAUGE

BACKGROUND OF THE INVENTION

1. Field of the Invention

This invention relates to the field of archery and pertains particularly to an apparatus used to achieve proper perpendicular alignment of the arrow in relation to the bow. The importance of this invention lies in the fact that no practiced methods of tuning a bow encompass a perfect alignment between the bow held at vertical position and the arrow at perpendicular position in relation to the bow. Once these two basics are achieved, fine tuning can occur upon the various bow components which assure that this precise alignment is maintained.

2. Description of the Prior Art

The accepted method of tuning bows, now as in the past, is based on trial and error. Fletched and unfletched arrows are shot at varying ranges and trial adjustments are made. This process is continued until the archer is satisfied with the grouping of his arrows. This method requires extensive shooting over a considerable period of time and the results are often disappointing.

SUMMARY OF THE INVENTION

The Bow Tuning Gauge is a mechanic device consisting of an elongated body and two sets of horizontal and vertical gauges attached thereto at either end, which when attached to the archery bow, enables the user to position an arrow shaft at the precise perpendicular state in relation to the bow. From this position, adjustments are then made to various components of the bow, including but not limited to the arrow rest and nock point, in order to achieve perfect tuned alignment between the bow and the arrow. The Bow Tuning Gauge's primary objective is to revolutionize the common trial and error method of tuning an archery bow. This is achieved by overcoming the problems related above in the prior art through the invention of the Bow Tuning Gauge which provides the means to precisely attain the proper tuned alignment between bow and arrow.

The distinctive method employed to assure such alignment is achieved by placing the proper arrow shaft in two metal clips which are at the end of each set of horizontal gauges of the device. These horizontal gauges are attached at the bottom of the vertical gauges and held in place by a lockscrew. Both sets of gauges are attached at either end of the Bow Tuning Gauge body. The body and attached gauges are secured to the bow by way of a dovetail tenon on the side of the elongated body inserted in a dovetail mortise which had been attached to the sight bracket holes in the bow handle. Once properly set, the arrow is held at perfect perpendicular alignment in relation to the bow and the necessary adjustments are then made to properly tune the bow.

BRIEF DESCRIPTION OF THE DRAWINGS

FIGS. 2A and 2B illustrate the Bow Tuning Gauge and a typical sight mounting bracket that is attached to the bow by means of studs and the threaded holes in the bow riser.

DETAILED DESCRIPTION OF THE PREFERRED EMBODIMENTS

Figure 1:
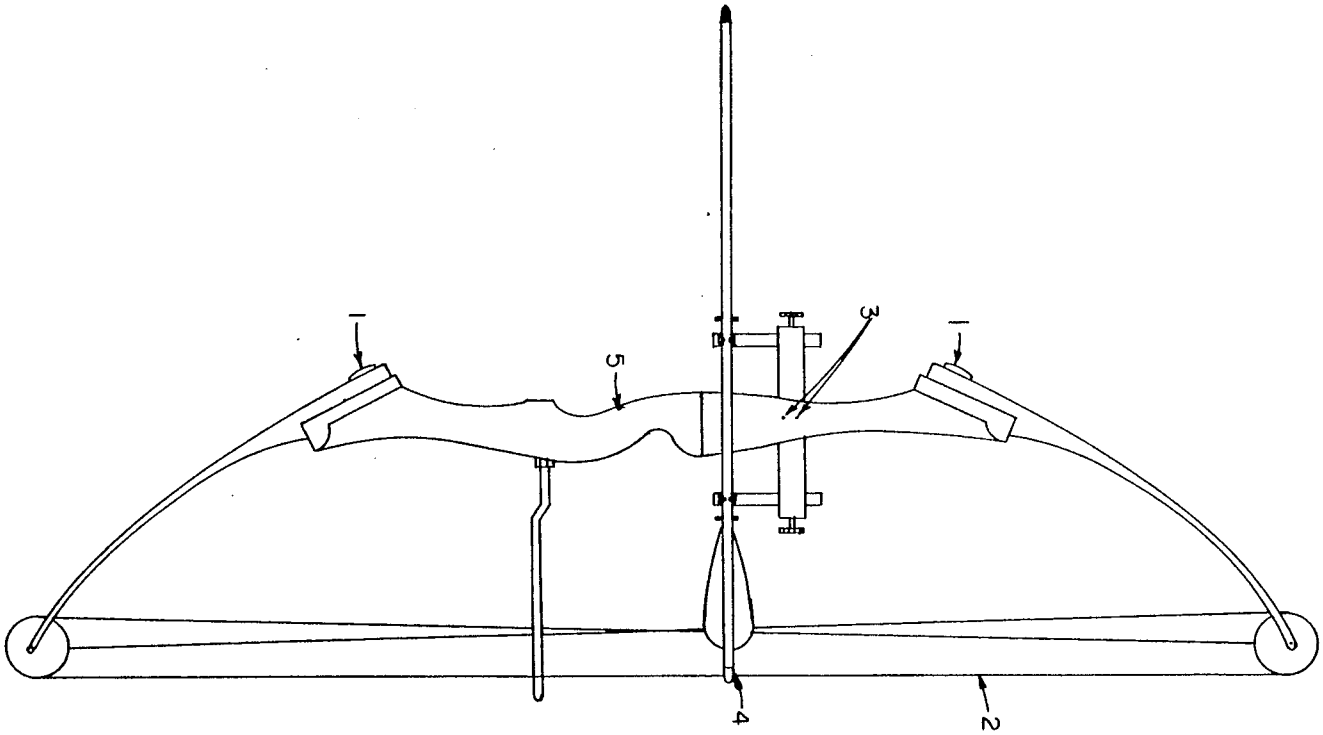
FIG. 1 illustrates the bow and identifies pertinent parts with Bow Tuning Gauge in position.

Quality bows of recent manufacturers have two threaded holes (3) in the riser (5) that are intended to accept sights, sight brackets, cable guards and/or quivers. A sight bracket with a dovetail mortise (6) is attached with two studs utilizing the two holes mentioned above (3). The dovetail tenon (7) on the bow tuning gauge body (13) is secured in the sight bracket by means of a lock screw (8). The bow is secured in a holding rack (The holding rack is not a part of this invention, it is merely a rack that holds the bow in a vertical position.) An arrow shaft is placed in the arrow clips (9). Using the horizontal gauges (10), the arrow shaft is moved left and right until the arrow shaft is in proper alignment with the bow string (center shot). The vertical gauges (11) are used to align the arrow shaft vertically across the tune hole. Once proper horizontal and vertical positions are found, the horizontal gauges (10) and vertical gauges (11) are locked in position by lockscrews (12). The arrow shaft is slid back to bow string (2) and string may then be nocked (4). After center shot has been located, arrow rest can be bolted on the bow in the optimum position.

The bow string and the nock end of the arrow do not necessarily move in a straight line when the bow is drawn. Limb twist or a lateral shift in the limb and riser junction causes the string to move left or right as the bow is drawn. The nock point is drawn because the two bow limbs have different resistance to bending or because the nock point is not positioned at the center of the string's length.

After using the Bow Tuning Gauge to determine the path, which is usually curved, that is followed by the nock end of the arrow, the user has the basis for adjusting or tuning the bow. Adjustments are made to place the arrow in such an attitude that the lines of force imparted by the bow string will be parallel to the axis of the arrow both vertically and horizontally. Positioning the arrow in this manner minimizes the yaw present in the attitude of the arrow at the start of its flight.

In the light of this disclosure, numerous variations in construction details of the Bow Tuning Gauge will occur to those skilled in the art without departing from the principle and spirit of the underlying invention.

What is claimed is:

1. A bow tuning gauge capable of being attached to an archery bow to locate the precise center shot and nock height while holding an actual shaft of an arrow that the archer will shoot in a horizontal position while the bow is relaxed, thereby enabling the archer to determine whether bow adjustments are necessary to improve the arrow flight comprising, an extension bar, means carried by said bar for mounting it on an archery bow;

two numeric ruled vertical gauges slidably mounted on said bar;

two numeric ruled horizontal gauges slidably mounted on said vertical gauges;

two arrow clips mounted on said horizontal gauges for holding the shaft of the arrow;

means for locking said numeric ruled vertical gauges in an adjusted position to said extension bar; and means for locking said numeric horizontal gauges in an adjusted position to said numeric ruled vertical gauges.

2. A bow tuning gauge capable of being attached to an archery bow to locate the precise center shot and nock height while holding an actual shaft of an arrow that the archer will shoot in a horizontal position while the bow is relaxed, thereby enabling the archer to determine whether bow adjustments are necessary to improve the arrow flight comprising, an extension bar, means carried by said bar for mounting it on an archery bow;

two numeric ruled vertical gauges slidably mounted on said bar;

two numeric ruled horizontal gauges slidably mounted on said vertical gauges;

two arrow clips mounted on said horizontal gauges for holding the shaft of the arrow;

said numeric ruled vertical gauges being held in an adjusted position to said extension bar; and said numeric horizontal gauges being held in an adjusted position to said numeric ruled vertical gauges.

* * * * *